US007800430B2

(12) United States Patent
Ferro

(10) Patent No.: US 7,800,430 B2
(45) Date of Patent: Sep. 21, 2010

(54) TEMPERATURE-COMPENSATED CURRENT GENERATOR, FOR INSTANCE FOR 1-10V INTERFACES

(75) Inventor: Alberto Ferro, Preganziol (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 32 days.

(21) Appl. No.: 12/226,501

(22) PCT Filed: Jun. 4, 2007

(86) PCT No.: PCT/EP2007/055454

§ 371 (c)(1),
(2), (4) Date: Nov. 19, 2008

(87) PCT Pub. No.: WO2007/141231

PCT Pub. Date: Dec. 13, 2007

(65) Prior Publication Data

US 2009/0079493 A1 Mar. 26, 2009

(30) Foreign Application Priority Data

Jun. 7, 2006 (EP) ..... 06425386

(51) Int. Cl.
*H01L 35/00* (2006.01)

(52) U.S. Cl. ..... 327/513; 327/538

(58) Field of Classification Search ..... 327/103, 327/513, 530, 537, 538, 543
See application file for complete search history.

(56) References Cited

U.S. PATENT DOCUMENTS 3,148,337 A 9/1964 Spohn
3,956,661 A * 5/1976 Sakamoto et al. ..... 327/513
4,297,697 A * 10/1981 Mitsui ..... 345/212
5,239,283 A 8/1993 Wiesgickl et al.
6,023,185 A * 2/2000 Galipeau et al. ..... 327/513
6,285,245 B1 * 9/2001 Watanabe ..... 327/540
6,316,990 B1 * 11/2001 Tanizawa ..... 327/538
6,407,621 B1 6/2002 Enriquez
6,542,027 B2 * 4/2003 Zha et al. ..... 327/540
6,556,082 B1 * 4/2003 Wang et al. ..... 330/288
6,865,150 B1 3/2005 Perkins et al.
7,193,452 B2 * 3/2007 Jeon et al. ..... 327/538

FOREIGN PATENT DOCUMENTS

JP 56017519 A 2/1981
JP 03034708 A 2/1991

* cited by examiner

*Primary Examiner*—Jeffrey S Zweizig
(74) *Attorney, Agent, or Firm*—Frishauf, Holtz, Goodman & Chick, P.C.

(57) ABSTRACT

A current generator arrangement for use, e.g., in 1-10V interfaces for lighting systems, includes at least one transistor (Q3) having a base-emitter junction wherein the voltage drop across the base-emitter junction defines the intensity of the output current and wherein the base-emitter junction is exposed to temperature drift. A resistive network ($R_{eq2}$) is coupled to the transistor (Q3), whereby the intensity of the output current is a function of both the voltage drop across the base-emitter junction of the transistor (Q3) and the resistance value of the resistive network ($R_{eq2}$). The resistive network ($R_{eq2}$) includes at least one resistor element (NTC3; NTC4) whose resistance value varies with temperature to keep constant the intensity of the output current irrespective of any temperature drift in the voltage drop across the base-emitter junction of the transistor (Q3).

9 Claims, 1 Drawing Sheet

TEMPERATURE-COMPENSATED CURRENT GENERATOR, FOR INSTANCE FOR 1-10V INTERFACES

This application is a U.S. National Phase Application under 35 U.S.C. 371 of International Application PCT/EP2007/055454, filed Jun. 4, 2007, which is incorporated herein in its entirety by this reference.

FIELD OF THE INVENTION

The present invention relates to techniques for compensating temperature effects in interfaces such as e.g. the interface commonly referred to as "1-10 V interface".

DESCRIPTION OF THE RELATED ART

At present, the 1-10 V interface represents a de facto standard in a number of industrial applications, in order to control electronic devices. In the area of lighting equipment, the 1-10 V interface is used for example to dim the intensity of a lighting source by means of a simple potentiometer or via external electronic control circuitry. Generally, the equipment is controlled by the voltage at the interface.

In order to obtain a voltage which is proportional to the value of an external resistor (i.e. a potentiometer), the best way is to include a current generator in the interface circuit. In that way, the voltage at the interface is related to the resistance value by Ohm's law. A simple and cheap current generator is comprised of a transistor, and the value of the current is determined by the junction voltage of the transistor taken as a reference. However, this reference voltage is heavily dependent on temperature. In most instances, this dependency represents a negative effect that should be compensated.

OBJECT AND SUMMARY OF THE INVENTION

The object of the present invention is thus to provide an effective solution to the problem described in the foregoing.

According to the present invention, that object is achieved by means of an arrangement having the features set forth in the claims that follow. The claims are an integral part of the disclosure of the invention provided herein.

BRIEF DESCRIPTION OF THE ANNEXED REPRESENTATIONS

Figure 1:
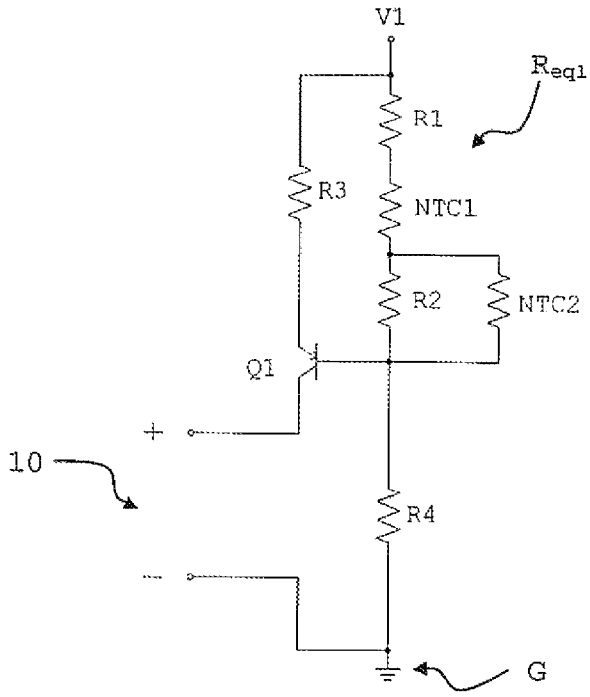
Figure 2:
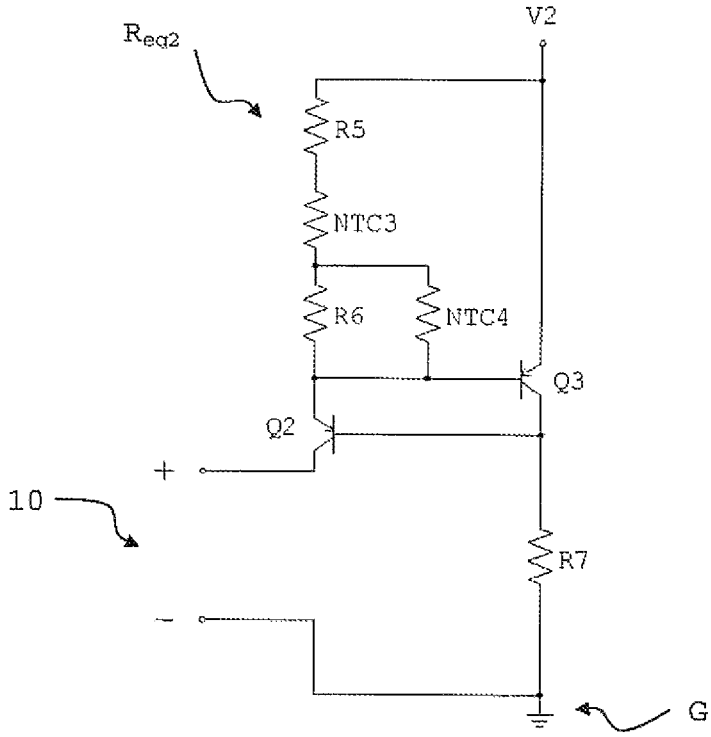

The invention will now be described, by way of example only, by referring to the enclosed representations, wherein:

FIG. 1 is a block diagram of a first embodiment of the arrangement described herein, and FIG. 2 is a block diagram illustrating an alternative embodiment of the arrangement described herein.

DETAILED DESCRIPTION OF EXEMPLARY EMBODIMENTS OF THE INVENTION

FIGS. 1 and 2 illustrate a first and a second exemplary embodiment of an electrical current generator as described herein.

Essentially, the arrangement described herein aims at generating, starting from a input dc voltage V1 (FIG. 1) or V2 (FIG. 2), a temperature-stabilized output current which is made available at output terminals 10. Essentially, the arrangement described herein is a temperature-stabilized current generator adapted to be used in connection with an external variable resistor (e.g. a potentiometer—not shown) to obtain a voltage which is proportional to the (variable) resistance value set on the potentiometer. A "dimming" action of that voltage may thus be produced e.g. over the 1-10V range within the framework of a 1-10V interface.

In both embodiments illustrated, the arrangement includes a (bipolar) p-n-p transistor Q1, Q2 that delivers the output current via its collector, which is connected to one of the output terminals 10, while the other output terminal is connected to ground G.

In FIG. 1, the base of the transistor Q1 is connected to the input voltage V1 via a resistive network whose overall resistance value can be regarded as the resistance value of a single resistor $R_{eq1}$.

This resistive network is in fact comprised of the series connection of:

- a first resistor R1,
- a first Negative Temperature Coefficient (NTC) resistor NTC1, and
- the parallel connection of a second resistor R2 and a second NTC resistor NTC2.

Additionally, the base of the transistor Q1 is connected to ground G via a resistor R4.

The arrangement of FIG. 2 includes a second transistor Q3 of the p-n-p type. The emitter of the transistor Q2 and the base of the transistor Q3 are connected to the input voltage V2 via a resistive network whose overall resistance value can be regarded as the resistance value of a single resistor $R_{eq2}$.

This resistive network is in fact comprised of the series connection of:

- a first resistor R5,
- a first Negative Temperature Coefficient (NTC) resistor NTC3, and
- the parallel connection of a second resistor R6 and a second NTC resistor NTC4.

As indicated, the emitter of the transistor Q2 is connected to the base of the transistor Q3, while the collector of the transistor Q3 is connected to the base of the transistor Q2. The emitter of the transistor Q3 is connected to the input voltage V2, and the base of the transistor Q2 (and the collector of the transistor Q3 connected thereto) are connected to ground G via a resistor R7.

In order to avoid making this description overly complicated, in both instances the base current of the transistor Q1, Q2 will be regarded as negligible, the same applying also to the transistor Q3 illustrated in FIG. 2.

Turning specifically to the arrangement of FIG. 1 (if the base current of the transistor Q1 is neglected) the voltage across the resistor R4 is equal to the current on the branch R4-$R_{eq1}$, multiplied by R4. Such current is equal to the supply-voltage $V_1$ divided by the sum of the resistance value of $R_4$ and $R_{eq1}$. Stated otherwise, the base voltage of the transistor Q1 is dictated by the value of the input voltage V1 as partitioned by the voltage divider comprised of R4 and $R_{eq1}$.

The voltage across R3 is equal to the supply-voltage V1 minus the base-emitter junction voltage of the bipolar transistor Q1 minus the voltage across R4. The output current from the collector of the transistor Q1 is essentially equal to the voltage across R3 divided by the resistance value of R3, and is thus a function of the voltage drop across the base emitter junction of the transistor Q1 and of the resistance value of $R_{eq1}$.

When the temperature increases, the base-emitter junction voltage of the transistor Q1 will decrease, and the interface current will tend to increase. The temperature increase will simultaneously produce a reduction in the resistance values of the two NTCs, namely NTC1 and NTC2; consequently, $R_{eq1}$ will decrease and the voltage across R4 (i.e. the base voltage of the transistor Q1) will increase in order to keep the emitter voltage of the transistor Q1 constant; therefore the voltage across R3 will remains quite constant, the same applying also to the output current from the collector for the transistor Q1.

This effect could be achieved even by using just one NTC (e.g. NTC1). However, using two NTCs with two respective fixed-value resistors R1 and R2, the latter connected in parallel to the associated NTC, namely NTC2, makes it possible to achieve, by a judicious selection of the resistance values of all the elements making up $R_{eq1}$ and of the temperature coefficients of the NTCs included therein, a more accurate compensation effect of the temperature drift.

In the alternative embodiment of FIG. 2 (if, again, the base currents of the transistors Q2, Q3 are neglected) the output current from the collector of the transistor Q2 is equal to the current that the same transistor Q2 receives over its emitter from the resistive network $R_{eq2}$. This current is in turn approximately equal to the base-emitter junction voltage of the bipolar transistor Q3 divided by $R_{eq2}$. The output current from the collector of the transistor Q2 is thus a function of the voltage drop across the base emitter junction of the transistor Q3 and of the resistance value of $R_{eq2}$. The current through the resistor R7 is the current needed to polarize the bipolar transistors Q2 and Q3.

When the temperature increases, the voltage drop across the base-emitter junction of Q3 will decrease, but also $R_{eq2}$ will decrease, so that the output current will remain quite constant.

Again, this effect could be notionally achieved by using just one NTC (e.g. NTC3). However, using two NTCs with two respective resistors R5 and R6, the latter connected in parallel to the associated NTC, namely NTC4, makes it possible to achieve, by a judicious selection of the resistance values of all the elements making up $R_{eq2}$ and of the temperature coefficients of the NTCs included therein, a more accurate compensation effect of the temperature drift.

A major advantage of the embodiment of FIG. 2 compared with the embodiment of FIG. 1 lies in that the output current will not be dependent on the supply voltage $V_2$.

Of course, without prejudice to the underlying principles of the invention, the details and the embodiments may vary, even significantly, with respect to what has been described and illustrated, just by way of example, without departing from the scope of the invention as defined in the annexed claims.

The invention claimed is:

1. An arrangement for generating an output current from an input voltage (V1, V2), the arrangement including:

at least one transistor (Q1; Q3) having a base-emitter junction wherein the voltage drop across said base-emitter junction determines the intensity of said output current and is exposed to temperature drift, a resistive network ($R_{eq1}$, $R_{eq2}$) coupled to said at least one transistor (Q1; Q3), whereby the intensity of said output current is a function of both the voltage drop across said base-emitter junction of said at least one transistor (Q1, Q3) and the resistance value of said resistive network ($R_{eq1}$, $R_{eq2}$)

wherein said resistive network ($R_{eq1}$, $R_{eq2}$) includes at least one first (NTC1; NTC3) and at least one second (NTC2; NTC4) resistor element (NTC1, NTC2; NTC3, NTC4) whose resistance value varies with temperature to keep constant the intensity of said output current irrespective of any temperature drift in said voltage drop across said base-emitter junction, and wherein said at least one first (NTC1; NTC3) and said at least one second (NTC2; NTC4) resistor element whose resistance value varies with temperature have associated respective fixed value resistors (R1, R5; R2, R6).

2. The arrangement of claim 1, characterized in that said at least one first (NTC1; NTC3) resistor element whose resistance value varies with temperature has an associated respective fixed value resistor (R1, R5) connected in series therewith.

3. The arrangement of either of claims 1 or 2, characterized in that said at least one second (NTC2; NTC4) resistor element whose resistance value varies with temperature has an associated respective fixed value resistor (R2, R6) connected in parallel therewith.

4. The arrangement of claim 1, characterized in that said at least one resistor element (NTC1, NTC2; NTC3, NTC4) whose resistance value varies with temperature is a Negative Temperature Coefficient resistor.

5. The arrangement of claim 1, characterized in that said resistive network ($R_{eq1}$) is included in a voltage divider (R4, $R_{eq1}$) that sets the base voltage of said at least one transistor (Q1), whereby the variation of the resistance of said at least one resistor element (NTC1, NTC2; NTC3, NTC4) whose resistance value varies with temperature produces a variation of the base voltage of said at least one transistor (Q1) countering the temperature drift in the voltage drop across said base-emitter junction.

6. The arrangement of claim 1, characterized in that said at least one transistor (Q1) has its emitter connected to said input voltage (V1) via a fixed value resistor (R3).

7. The arrangement of either of claim 1 or 2, characterized in that said resistive network ($R_{eq2}$) is connected across the base-emitter junction of said at least one transistor (Q3), whereby said resistive network ($R_{eq2}$) is traversed by a current given by the ratio of said voltage drop across said base-emitter junction of said at least one transistor (Q3) to the resistance value of said resistive network ($R_{eq2}$), whereby the variation of the resistance of said at least one resistor element (NTC3, NTC4) whose resistance value varies with temperature maintains said ratio constant by countering the temperature drift in the voltage drop across said base-emitter junction.

8. The arrangement of claim 7, characterized in that it includes a further transistor (Q2) fed with the current traversing said resistive network ($R_{eq2}$) and producing therefrom said output current.

9. The arrangement of claim 8, characterized in that said further transistor (Q2) receives the current traversing said resistive network ($R_{eq2}$) and produces therefrom said output current via its emitter and collector, respectively.

* * * * *